US005558568A

United States Patent [19]

Talieh et al.

[11] Patent Number: 5,558,568

[45] Date of Patent: Sep. 24, 1996

[54] WAFER POLISHING MACHINE WITH FLUID BEARINGS

[75] Inventors: Homayoun Talieh, San Jose; David E. Weldon, Los Gatos; Boguslaw A. Nagorski, San Jose, all of Calif.

[73] Assignee: Ontrak Systems, Inc., Milpitas, Calif.

[21] Appl. No.: 333,463

[22] Filed: Nov. 2, 1994

Related U.S. Application Data

[63] Continuation-in-part of Ser. No. 321,085, Oct. 11, 1994.

[51] Int. Cl.[6] ..... B24B 21/00

[52] U.S. Cl. ..... 451/303; 451/490

[58] Field of Search ..... 451/303, 307, 451/495, 488, 449; 384/99, 102, 2; 198/811

[56] References Cited

U.S. PATENT DOCUMENTS

| | | | |
|---|---|---|---|
| 619,399 | 2/1899 | Fischer | 451/163 |
| 3,447,306 | 6/1969 | Jakimcius | 451/297 |
| 3,654,739 | 4/1972 | Stoy et al. . | |
| 3,753,269 | 8/1973 | Budman | 15/160 |
| 3,906,678 | 9/1975 | Roth | 51/154 |
| 4,347,689 | 9/1982 | Hammond | 51/281 SF |
| 4,416,090 | 11/1983 | Jonasson | 451/303 |
| 4,593,495 | 6/1986 | Kawakami et al. | 51/118 |
| 4,628,640 | 12/1986 | Johannsen | 451/303 |
| 4,642,943 | 2/1987 | Taylor, Jr. | 451/303 |
| 4,704,823 | 11/1987 | Steinback | 51/110 |
| 4,811,522 | 3/1989 | Gill, Jr. . | |
| 4,934,102 | 6/1990 | Leach | 51/50 R |
| 4,941,293 | 7/1990 | Ekhoff | 51/168 |
| 5,081,795 | 1/1992 | Tanaka et al. | 51/131.1 |
| 5,205,082 | 4/1993 | Shendon et al. . | |
| 5,212,910 | 5/1993 | Breivogel . | |
| 5,230,184 | 7/1993 | Bukhman | 51/283 R |
| 5,232,875 | 8/1993 | Tuttle et al. | 451/63 |
| 5,246,525 | 9/1993 | Sato | 156/345 |
| 5,274,964 | 1/1994 | Simpson et al. | 51/417 |
| 5,276,999 | 1/1994 | Bando | 51/62 |
| 5,287,663 | 2/1994 | Pierce et al. . | |
| 5,297,361 | 3/1994 | Baldy et al. | 51/119 |
| 5,329,732 | 7/1994 | Karlsrud et al. . | |
| 5,329,734 | 7/1994 | Yu . | |
| 5,335,453 | 8/1994 | Baldy et al. | 451/41 |
| 5,399,125 | 3/1995 | Dozier | 451/303 |
| 5,456,627 | 10/1995 | Jackson et al. | 451/11 |

FOREIGN PATENT DOCUMENTS

| | | |
|---|---|---|
| 0517594A1 | 12/1992 | European Pat. Off. . |
| 0517595A1 | 12/1992 | European Pat. Off. . |
| 3411120A1 | 11/1984 | Germany . |
| 59-232768 | 12/1984 | Japan . |
| 62-162466 | 7/1987 | Japan . |

(List continued on next page.)

OTHER PUBLICATIONS

"A New Pad and Equipment Development for ILD Planarization" by Toshiyasu Beppu, Motoyuki Obara and Yausuo Minamikawa, Semiconductor World, Jan., 1994, MY Mar. 17, 1994.

"Application of Chemical Mechanical Polishing to the Fabrication of VLSI Circuit Interconnections", William J. Patrick, William L. Guthrie, Charles L. Stadley and Paul M. Schiable, J. Electrochem. Soc., vol. 138, No. 6, Jun. 1991, pp. 1778–1784.

"Theory & Practice of Lubrication for Engineers", Dudley Fuller, Wiley–Interscience, 1st ed., pp. 22–25 and 86.

Practical Ideas, Jun. 1994, p. 67.

*Primary Examiner*—D. S. Meislin
*Assistant Examiner*—Andrew Weinberg
*Attorney, Agent, or Firm*—Brinks Hofer Gilson & Lione

[57] ABSTRACT

A semi-conductor wafer polishing machine having a polishing pad assembly and a wafer holder includes a support positioned adjacent the polishing pad assembly. The support includes multiple fluid bearings that support the polishing pad assembly on the support. These fluid bearings are arranged concentrically to provide concentric regions of support for the polishing pad assembly, and each fluid bearing is coupled to a respective source of pressurized fluid at a respective pressure.

17 Claims, 10 Drawing Sheets

FOREIGN PATENT DOCUMENTS

| | | | |
|---|---|---|---|
| 63-200965 | 8/1988 | Japan . | |
| 63-251166 | 10/1988 | Japan . | |
| 63-267155 | 11/1988 | Japan . | |
| 2269552 | 11/1990 | Japan . | |
| 2269553 | 11/1990 | Japan . | |
| 49209 | 9/1992 | Japan | 451/307 |
| 7111256 | 4/1995 | Japan . | |
| 2007784 | of 1994 | Russian Federation . | |
| 94/17957 | 8/1994 | WIPO . | |

10
12
14
16
18
20
22
24
26
28
30
32
42
W
X

WAFER POLISHING MACHINE WITH FLUID BEARINGS

CROSS-REFERENCE TO RELATED APPLICATION

This application is a continuation-in-part of copending U.S. patent application Ser. No. 08/321,085, filed Oct. 11, 1994.

BACKGROUND OF THE INVENTION

This invention relates to chemical mechanical polishing machines for planarizing semi-conductor wafers; and in particular to such machines having improved bearings.

Chemical mechanical polishing machines for semiconductor wafers are well known in the art, as described for example in U.S. Pat. Nos. 5,335,453, 5,329,732, 5,287,663, 5,297,361 and 4,811,522. Typically, such polishing machines utilize mechanical bearings for the polishing pad and the wafer holder. Such mechanical bearings can provide disadvantages in operation. Mechanical bearings can become contaminated with the abrasive slurry used in the polishing process. If mechanical bearings provide point or line support for a polishing pad platen, the possibility of cantilever bending of the platen arises. Bearing vibrations can result in undesirable noise, and bearing adjustment typically requires a mechanical adjustment of the assembly. This adjustment is typically a high-precision, time-consuming adjustment.

It is an object of the present invention to provide a chemical mechanical polishing machine having fluid bearings that to a large extent overcome the problems set out above, and that can easily be adjusted to control polishing forces.

SUMMARY OF THE INVENTION

This invention relates to semi-conductor wafer polishing machines of the type comprising at least one polishing pad assembly and at least one wafer holder positioned to hold a semi-conductor wafer against the polishing pad assembly.

According to this invention, such a wafer polishing machine is provided with a support positioned adjacent the polishing pad assembly. At least one of the support and the polishing pad assembly comprises a plurality of fluid bearings that support the polishing pad assembly on the support. Each of the fluid bearings comprises a respective fluid supply conduit connectable to a respective source of fluid at a respective pressure and a respective set of fluid pads. Each of the fluid pads within a given fluid bearing is in fluid communication with the respective fluid supply conduit. The fluid pads are configured to direct fluid from the respective fluid supply conduit to support in part the polishing pad assembly on the support. Preferably, at least some of the sets of fluid pads are arranged in respective concentric rings. With this arrangement support forces for the polishing pad assembly can be varied across the face of the wafer being polished, thereby enhancing uniform polishing rates.

The invention itself, together with further objects and attendant advantages, will best be understood by reference to the following detailed description, taken with the accompanying drawings.

DETAILED DESCRIPTION OF THE PRESENTLY PREFERRED EMBODIMENTS

Figures 1, 2:
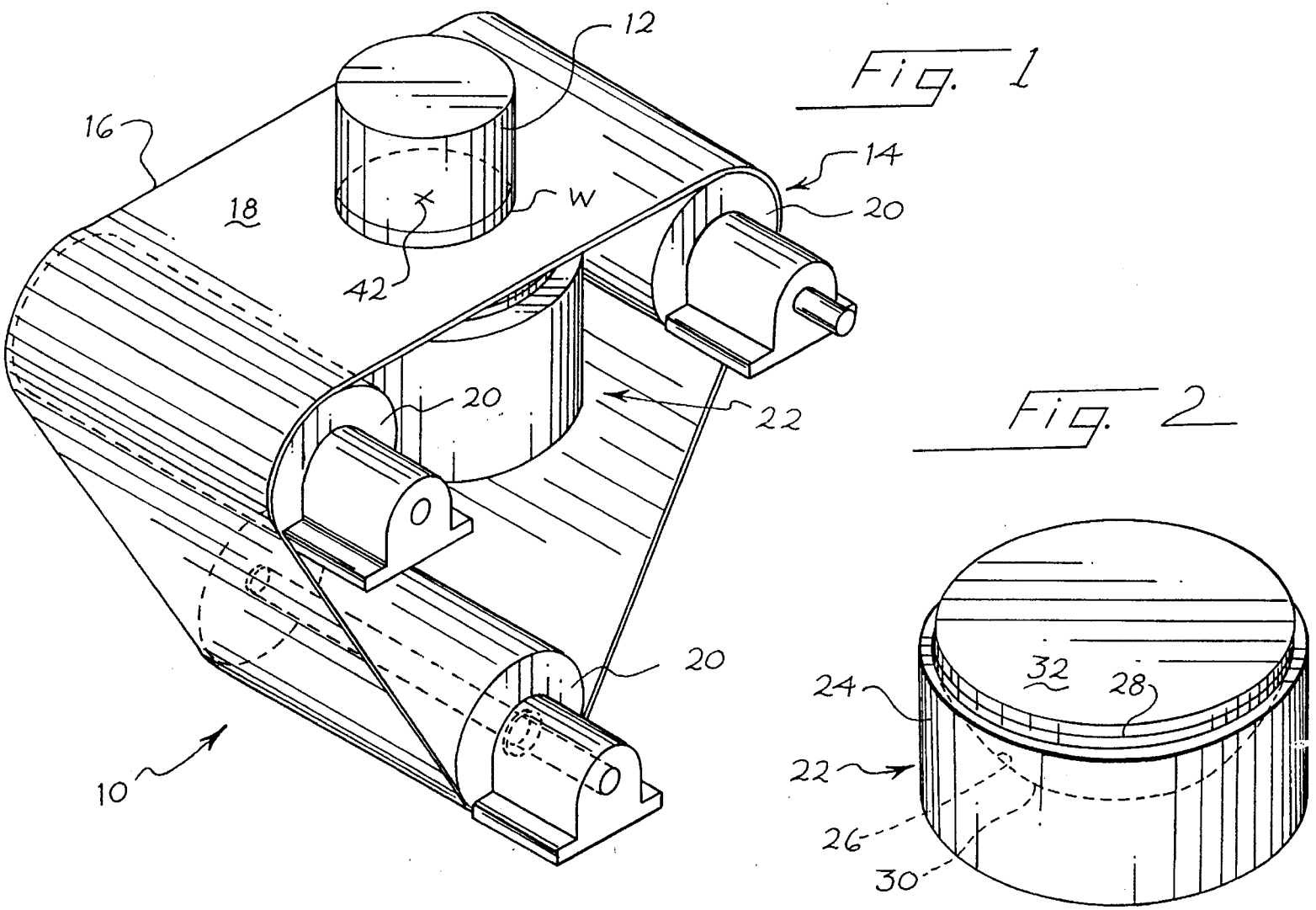
FIG. 1 is a perspective view of a chemical mechanical wafer polishing machine.
FIG. 2 is a perspective view of a belt support assembly included in the polishing machine of FIG. 1.
Figure 3:
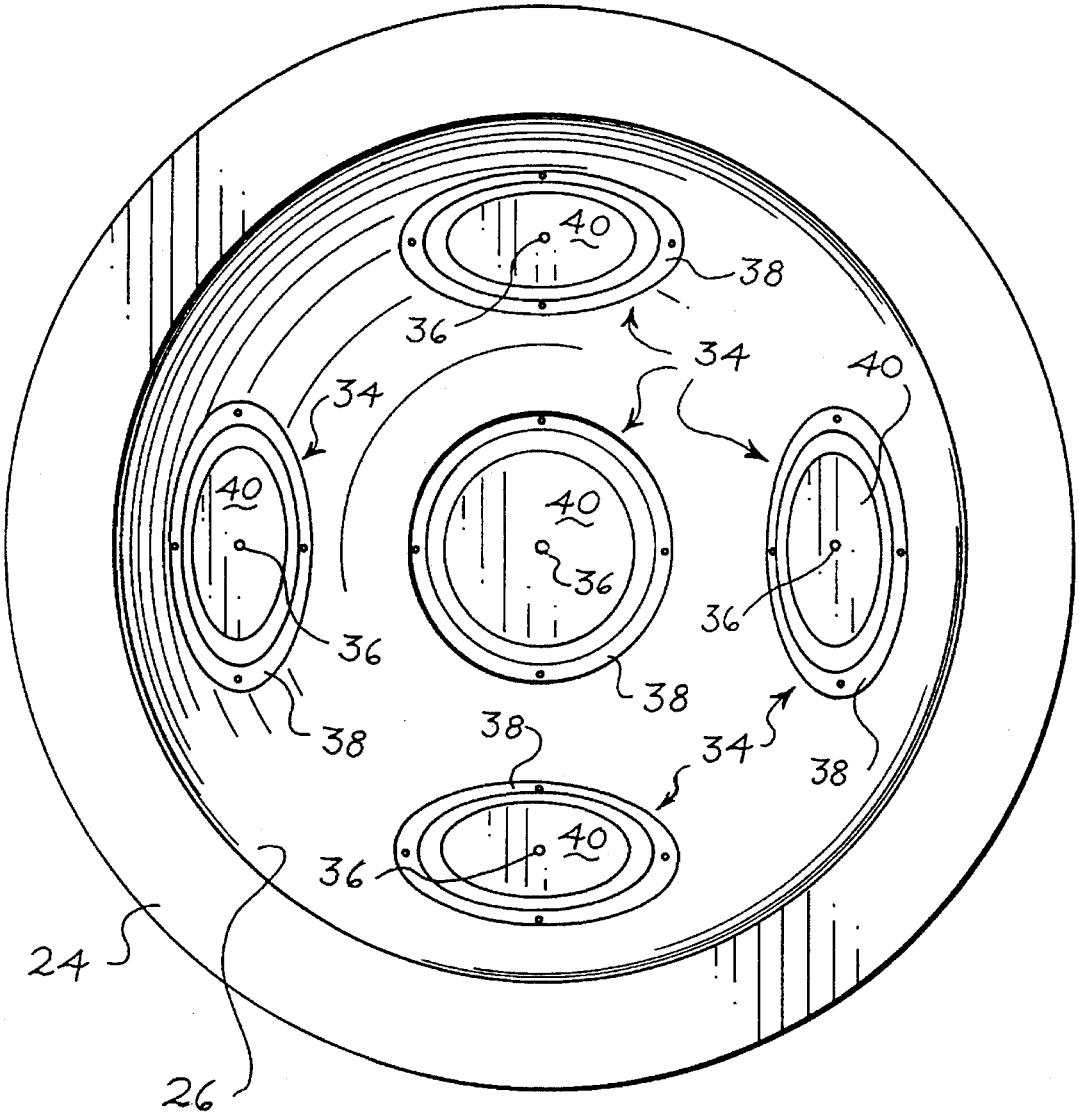
FIG. 3 is a top view of hydrostatic bearings included in the belt support assembly of FIG. 2.
Figure 4:
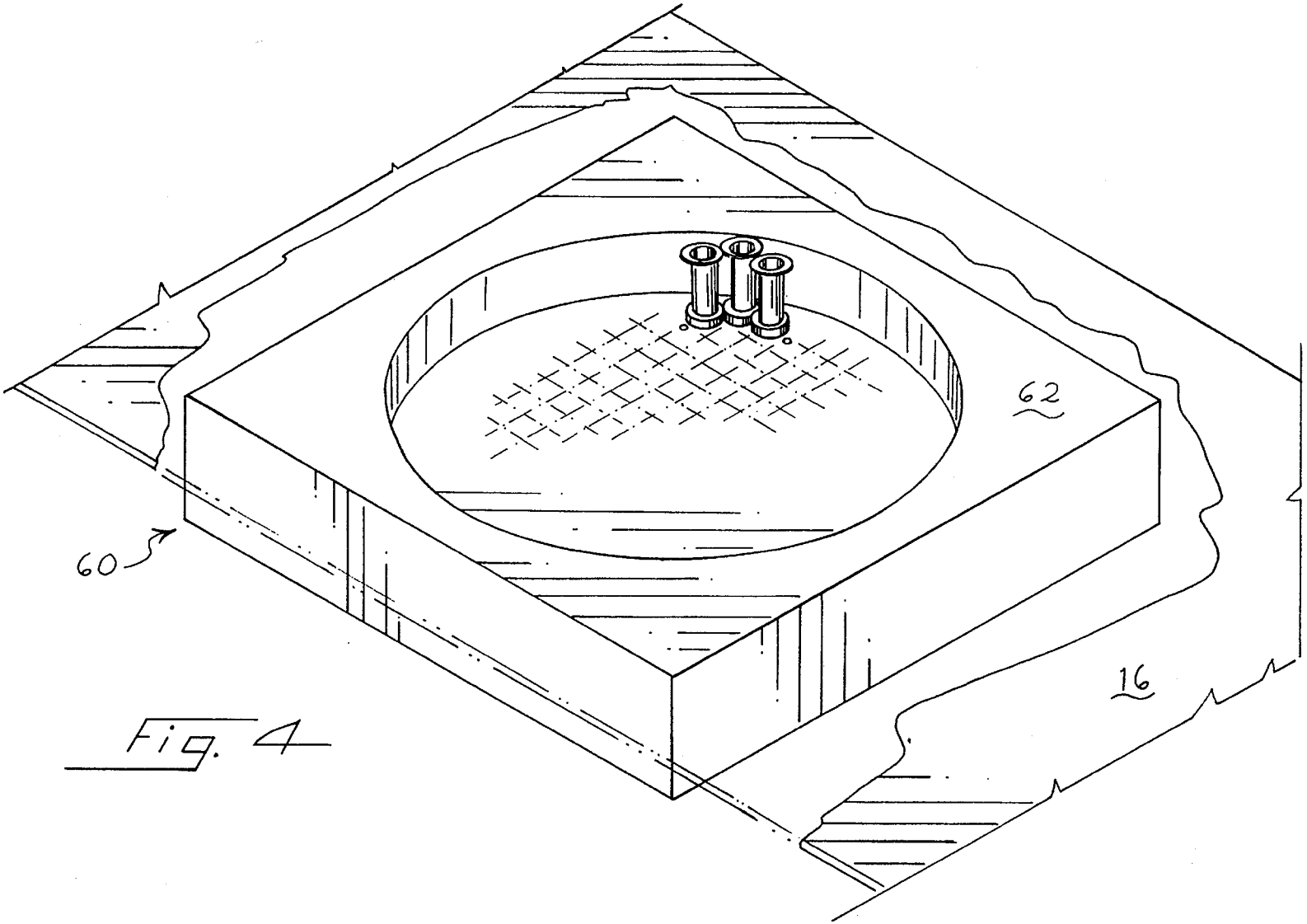
FIG. 4 is a perspective view of portions of another chemical mechanical wafer polishing machine.

Turning now to the drawings, FIGS. 1–3 relate to a chemical mechanical wafer polishing machine 10 that incorporates a wafer holder 12 which holds a wafer W against a polishing pad assembly 14. The polishing pad assembly 14 includes a belt 16 which carries on its outer surface one or more polishing pads 18. The belt 16 travels over rollers 20 which are driven in rotation to cause the belt to move linearly past the wafer holder 12. The belt 16 is supported with respect to movement away from the wafer W by a belt support assembly 22 which is shown more clearly in FIG. 2. The belt support assembly 22 includes a support 24 which is fixedly mounted in position with respect to the rollers 20. This support 24 defines a hemispherical recess 26 which supports a belt platen 28. The belt platen 28 defines a lower hemispherical surface 30 that is received within the recess 26 to form a ball joint. The uppermost portion of the platen 28 defines a belt support surface 32. The belt 16 may be wetted and the belt support surface 32 may be grooved to prevent the belt 16 from hydro-planing. Alternatively, the belt support surface 32 may be formed of a low-friction bearing material.

Further details regarding the wafer polishing machine 10 can be found in U.S. patent application Ser. No. 08/287,658 filed Aug. 9, 1994, assigned to the assignee of this invention. This application is hereby incorporated by reference in its entirety.

The platen 28 and the support 24 form at least one fluid bearing which allows low-friction movement of the platen 28 with respect to the support 24. FIG. 3 is a top view into the recess 26 with the platen 28 removed. As shown in FIG. 3, the recess 26 defines a total of five fluid bearings 34 in this embodiment. One of these fluid bearings 34 is larger than the other four and is positioned centrally. The remaining four fluid bearings 34 are positioned symmetrically around the central fluid bearing. Each of the fluid bearings includes a central fluid inlet 36 which is connectable to a source of fluid under pressure and a respective fluid outlet 38 that is annular in shape and extends around the fluid inlet 36. Each fluid outlet 38 is connectable to a drain of fluid at a lower pressure than that of the source. The region of the recess 26 between the fluid inlet 36 and the fluid outlet 38 forms a bearing surface 40. In use, fluid is pumped from the fluid inlet 36 across the bearing surface 40 to the fluid outlet 38. In this way a film of fluid is formed over the bearing surface 40, and it is this film of fluid that supports the hemispherical surface 30 of the platen 28.

The larger central fluid bearing 34 supports the platen 28 against movement away from the belt 16. The four smaller fluid bearings 34 provide self-centering characteristics in order maintain the platen 28 centered in the recess 26.

Returning to FIGS. 1 and 2, the recess 26 and the hemispherical surface 30 are shaped such that the center of rotation 42 of the ball joint formed by the support 24 and the platen 28 is positioned substantially at the front surface of the wafer W that is being polished. In this way, tilting moments on the platen 28 are minimized and any tendency of the ball joint formed by the platen 28 and the support 24 to press the belt 16 with greater force into the leading edge of the wafer W is minimized or eliminated.

Figure 5:
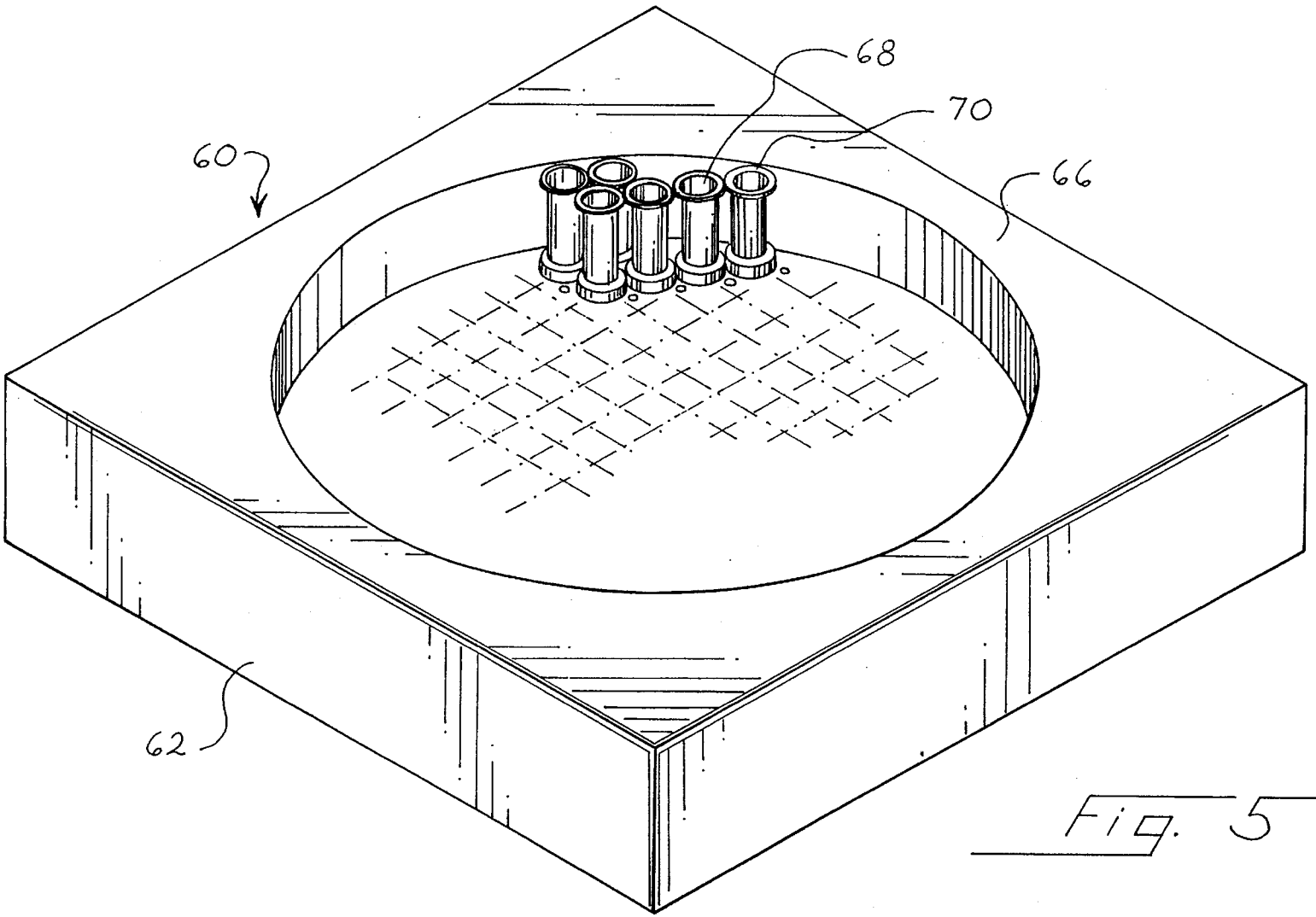
FIG. 5 is a perspective view of the belt support assembly of the polishing machine of FIG. 4.
Figure 6:
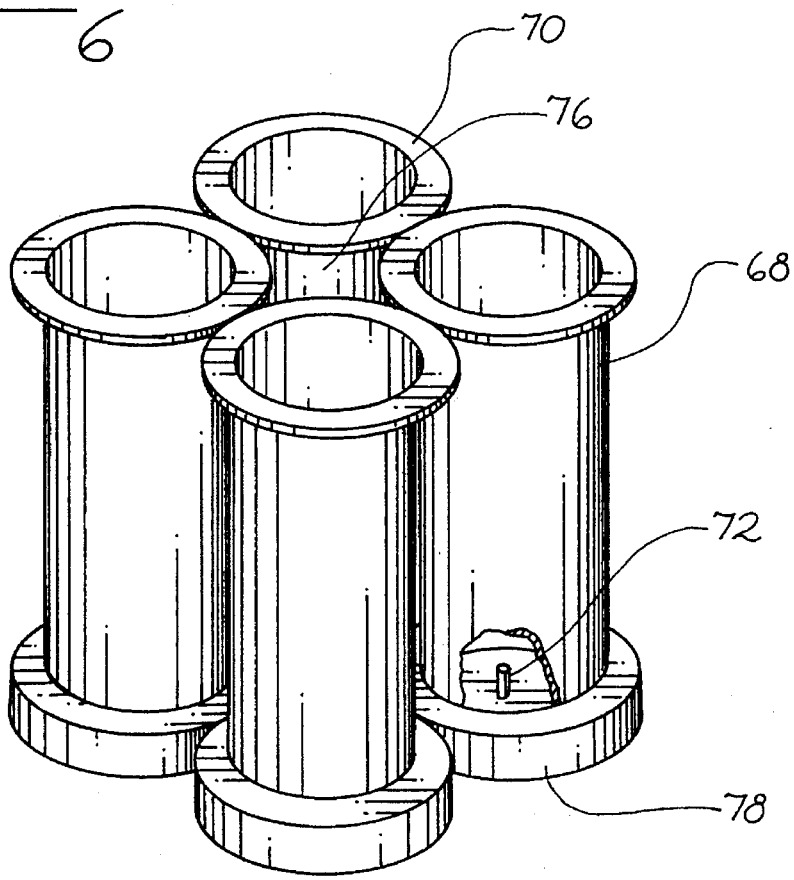
FIG. 6 is a perspective view at an expanded scale of a portion of the belt support assembly of FIG. 5.
Figure 7:
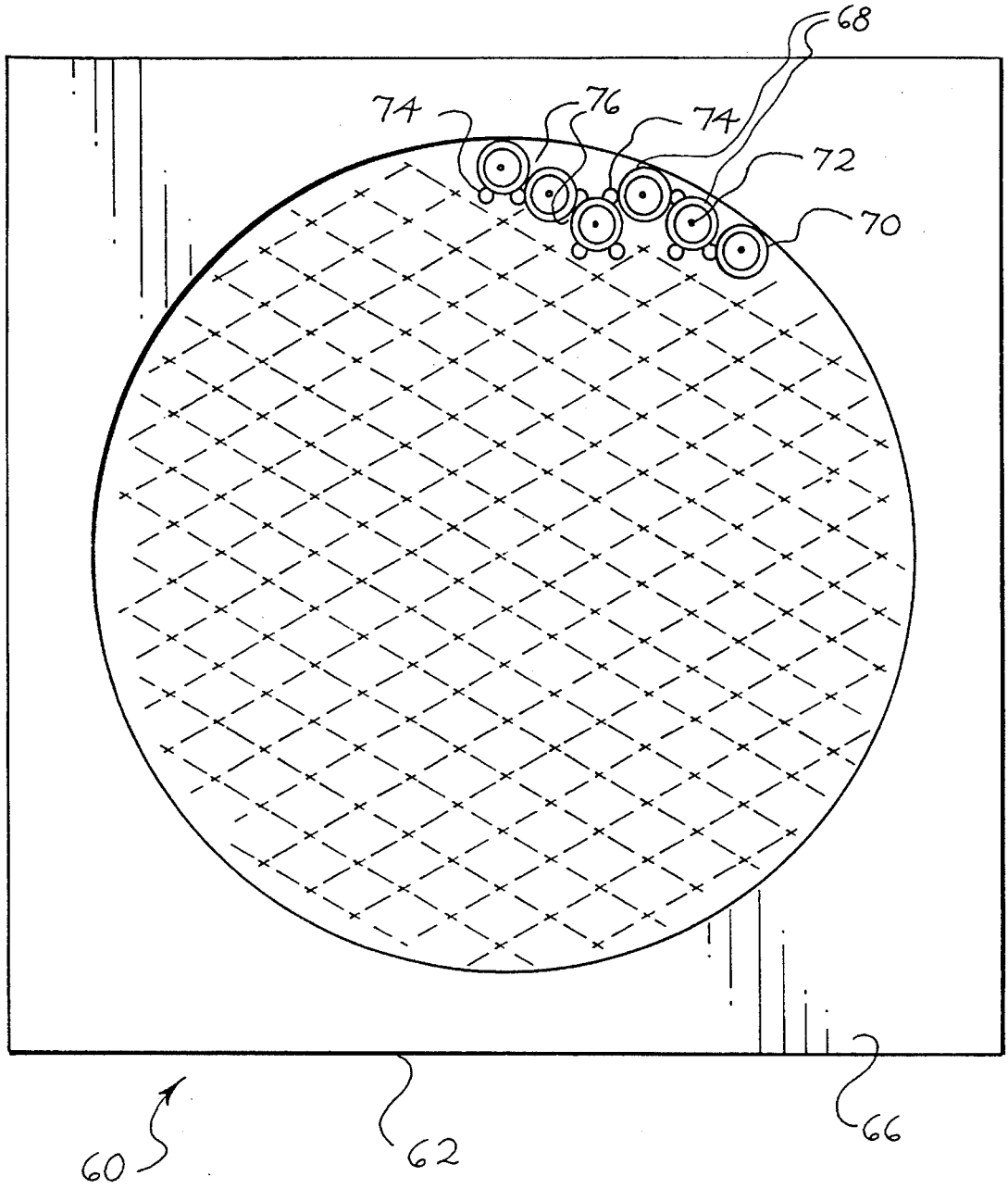
FIG. 7 is a top view of the belt support assembly of FIG. 5.

FIGS. 4–7 relate to a wafer polishing machine in which the belt 16 is supported by a belt support assembly 60. This belt support assembly 60 includes a support 62 which acts as a manifold for pressurized fluid and includes a raised peripheral rim 66 (FIG. 5). A plurality of cylindrical tubes 68 are contained within the rim 66, and each of these tubes 68 defines an exposed annular end surface 70. The manifold is connected to the interiors of tubes 68 via fluid inlets 72, and a plurality of fluid outlets 74 are provided as shown in FIG. 7. Individual ones of the tubes 68 are sealed to the support 62 by seals 78 that allow a controlled amount of movement of the tubes 68. For example, the seal 78 can be formed of an elastomeric O-ring which bears against a lower cap of the tube 68, and the fluid inlet 72 can be a hollow fastener that secures the tube 68 to the support 62 and compresses the seal 78. As best shown in FIGS. 6 and 7, interstitial spaces 76 between adjacent tubes 68 allow fluid to flow out of the tubes 68 to the fluid outlets 74.

Simply by way of example, the tubes 68 can define an array having a diameter of about eight inches, and 187 tubes can be used, each having an outside diameter of ½ inch and an inside diameter of ⅜ inch, and the fluid inlets 72 can be about 0.030 inches in diameter.

In use, the manifold is connected to a source of fluid such as water at an elevated pressure, and the fluid outlets 74 are connected to a fluid drain at a lower pressure such as atmospheric pressure. Fluid flows into the tubes 68 via the fluid inlet 72, across the end surfaces 70 which act as bearing surfaces, via the interstitial spaces 76 and the fluid outlets 74 to the fluid drain. The fluid flow over the end surfaces 70 provides broad-area support for the belt 16.

FIGS. 1–7 are included in co-pending U.S. patent application Ser. No. 08/321,085, filed Oct. 11, 1994. The entirety of this co-pending application is hereby incorporated by reference.

Figure 8:
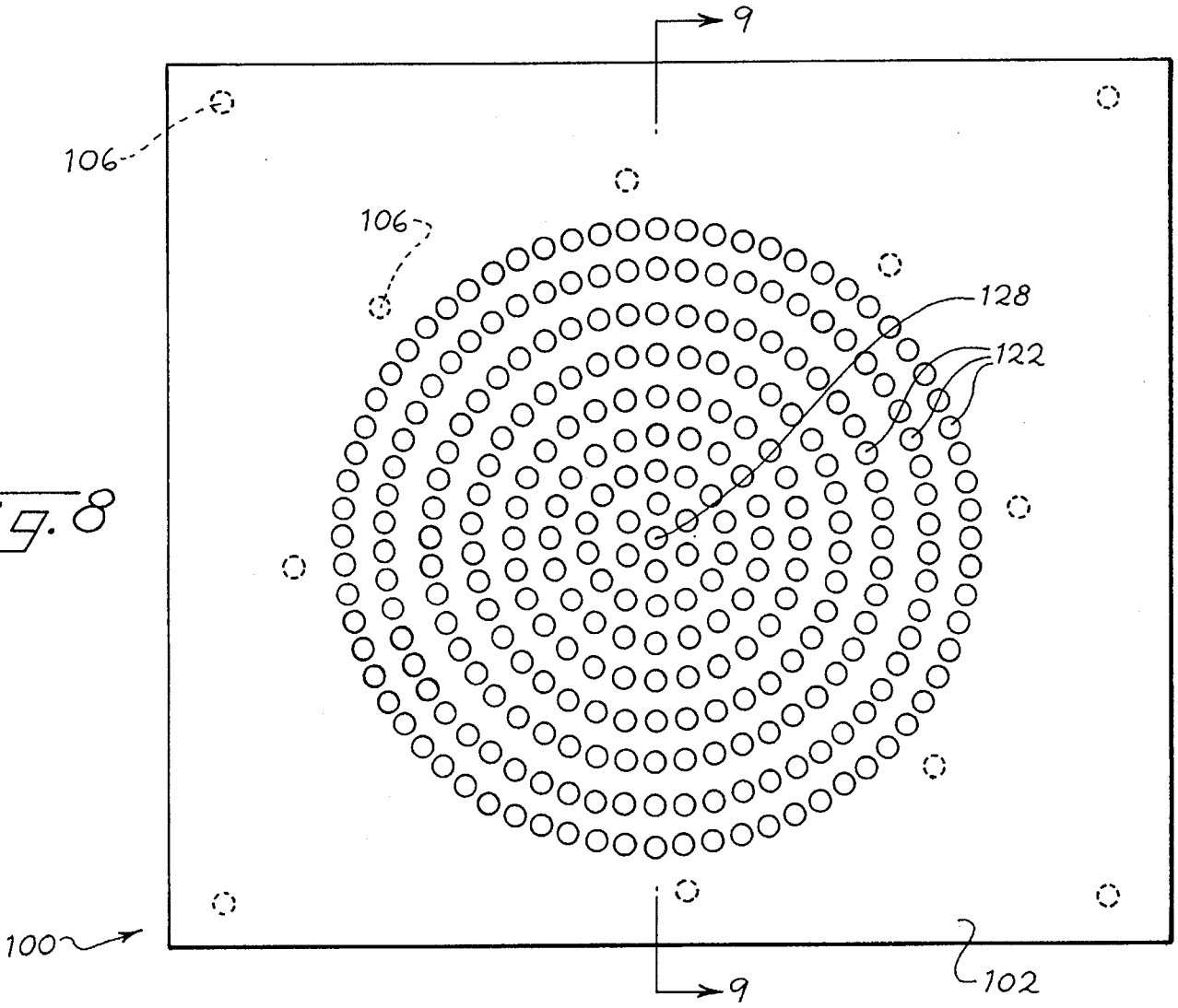
FIG. 8 is a top view of another belt support assembly suitable for use in the polishing machine of FIG. 4.
Figure 9:
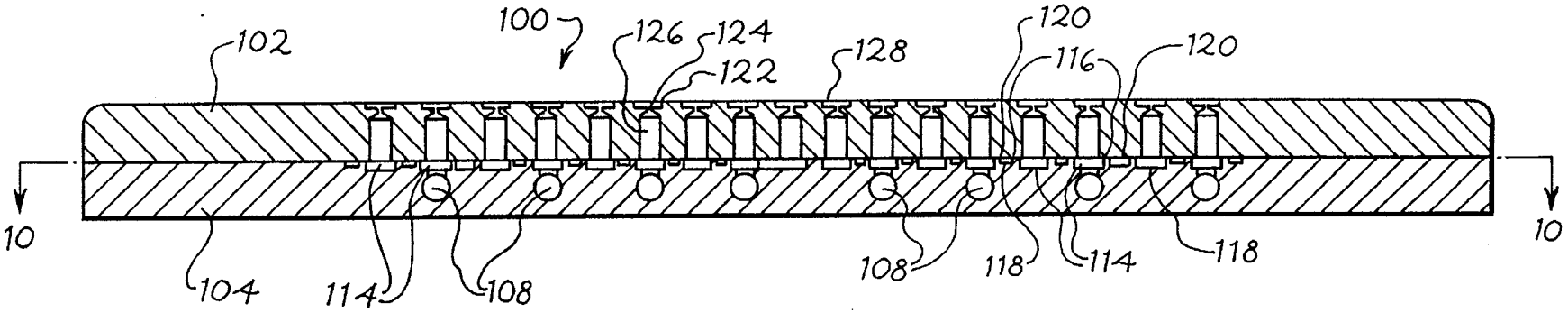
FIG. 9 is a cross-sectional view taken along line 9—9 of FIG. 8.
Figure 11:
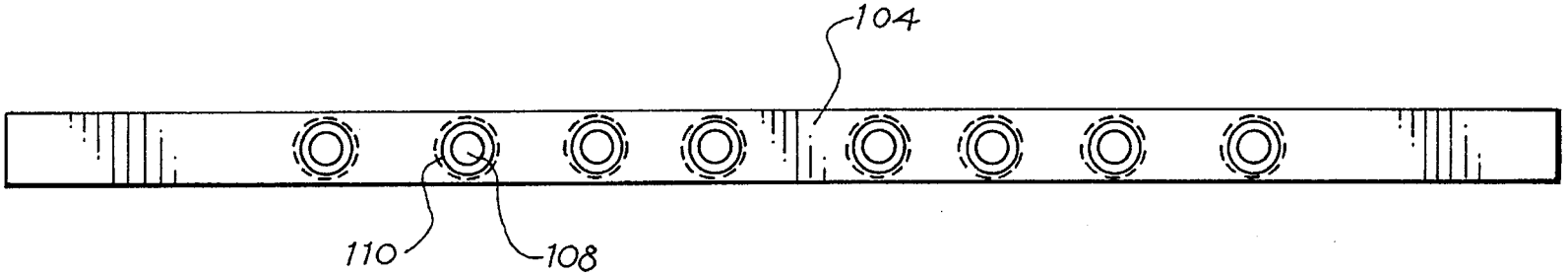
FIG. 11 is a side view taken along line 11—11 of FIG. 10.
Figure 10:
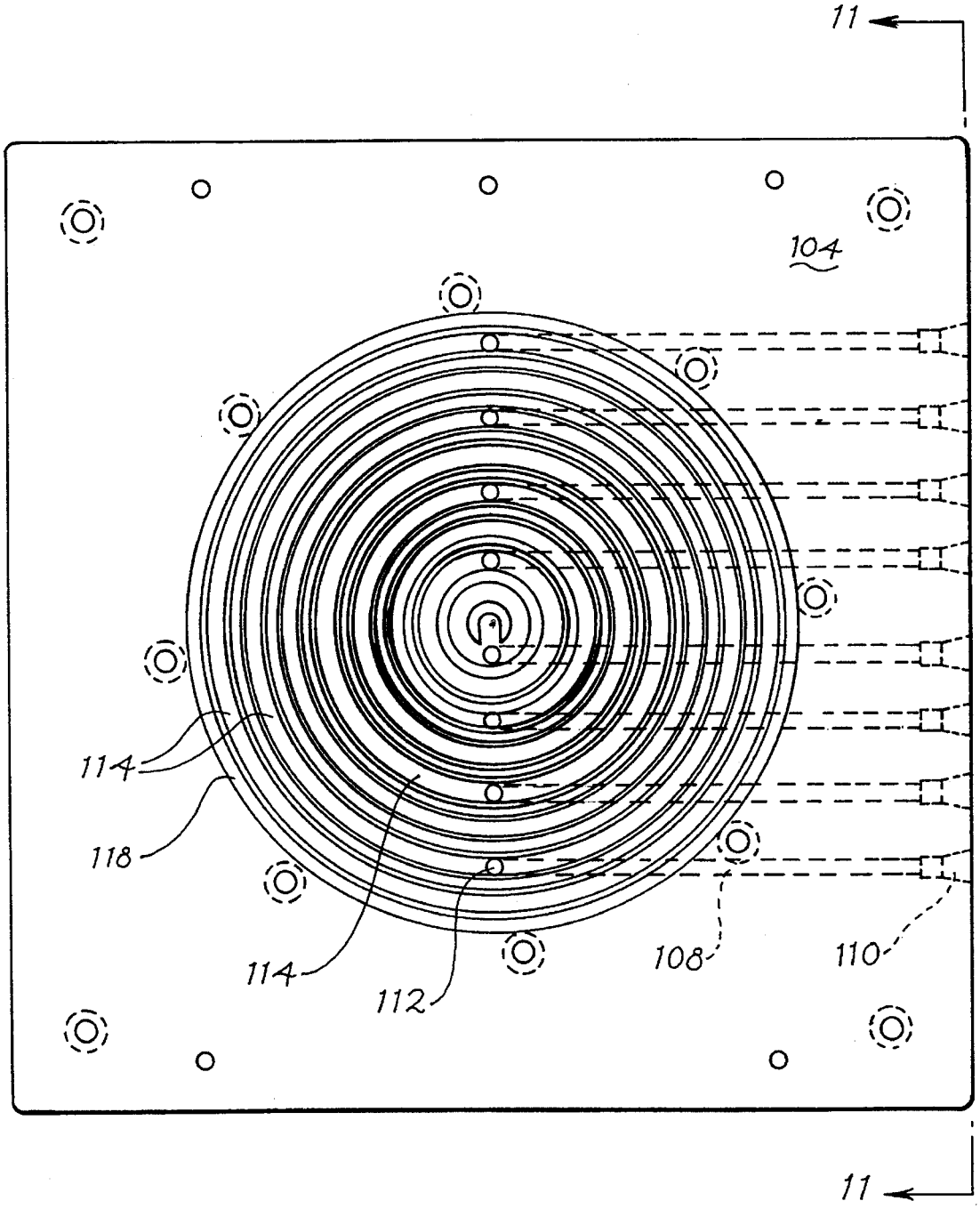
FIG 10 is a cross-sectional view taken along line 10—10 of FIG. 9.

Turning now to FIGS. 8–12, these figures show another support 100 that can for example be used to support the polishing pad assembly 14 in the wafer polishing machine 10. This support 100 includes an upper plate 102 and a lower plate 104 which are held together by fasteners 106. As best shown in FIGS. 9 and 10, the lower plate 104 defines eight fluid supply conduits 108, each having a respective threaded end 110 and a discharge end 112. The threaded ends 110 in use are each connected to a separate respective source of pressurized fluid at a separate respective pressure. The discharge ends 112 are each in fluid communication with a respective one of eight concentric grooves 114. As best shown in FIG. 9, adjacent ones of the concentric grooves 114 are separated by lands 118 which define O-ring receiving grooves 118. O-rings 120 are positioned in the grooves 118 to create a seal between the upper and lower plates 102, 104 between adjacent concentric grooves 114.

Figure 12:
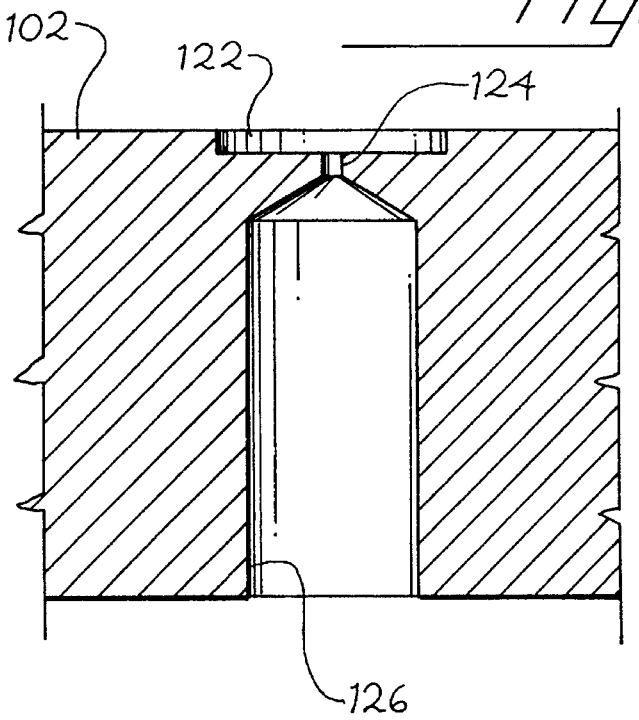
FIG. 12 is an enlarged view of a portion of the belt support assembly of FIG. 9.

As best shown in FIGS. 8, 9 and 12, the upper plate 102 defines eight circular arrays of fluid pads 122, each array aligned with a respective one of the concentric grooves 114. Each fluid pad 122 is connected by means of an orifice 124 and a bore 126 to the respective groove 114. The central fluid pad 128 is in fluid communication with the innermost concentric groove 114, as shown in FIGS. 9 and 10.

In use, fluid is supplied under respective pressures to the conduits 108 and it flows via the conduits 108, the grooves 104, the bores 126 and the orifices 128 to the fluid pads 122. Pressurized fluid then is directed against the polishing pad assembly and it tends to flow radially outwardly to a drain (not shown) at a lower pressure. Though not intending to be bound by any theory, it is believed that the support 100 may utilize three different modes of lubrication: hydrostatic fluid lubrication at the outer fluid bearing, localized hydrodynamic fluid lubrication inside the hydrostatic region and mixed fluid film lubrication at the points of asperity contact.

The arrangement shown in FIGS. 8–12 creates in effect eight separate fluid bearings. Each of these fluid bearings includes a respective circle of fluid pads 122 aligned with the respective concentric groove 114. In addition, the innermost fluid bearing includes the central pad 128. Each of these fluid bearings operates with a fluid such as water conducted via a respective fluid supply conduit 108 at a respective pressure. When the support 100 is used to support a belt type polishing pad assembly 14 (FIG. 1), the concentric fluid bearings of the support 100 remain in a fixed position with respect to the wafer being polished. By properly adjusting the fluid pressure in the various fluid bearings, a wide range of pressure profiles can be provided. For example, if a wafer being polished is experiencing non-uniform polishing rates between the periphery and the center of the wafer the pressure of the peripheral fluid bearings can be either increased or decreased with respect to the pressure of the central fluid bearings in order to make the polishing rate more uniform across the surface of the wafer being polished. In effect, the concentric fluid bearings provide concentric regions of support which can be precisely adjusted by adjusting the pressure in the fluid in the respective conduit 108.

In the embodiment discussed above, the fluid pads 122 direct fluid to support the underside of the polishing pad assembly 14. In an alternate embodiment (not shown), the support 100 can be used with a rotating polishing pad assembly rather than one which moves linearly as described above. Also, though the fluid bearings have been shown on the support, they could be formed on the polishing pad assembly in alternative embodiments.

It should be understood that the support 60 of FIGS. 4–7 can be modified to provide multiple regions of support operating at different fluid pressures. For example, the fluid inlets 72 can be connected to separate respective manifolds such that the fluid inlets 72 in concentric rings are supplied with fluid at respective pressures. Alternately, the fluid inlets 72 can be connected to manifolds at respective pressures in other spatial patterns if desired.

Simply by way of example, the individual fluid pads 122 can be 0.25 inch in diameter by 0.05 inch in depth, and the orifices 124 can be 0.020 inches in diameter. The upper and lower plates 102, 104 can be formed of a stainless steel such as type 304, and the fluid bearings on the support 100 can have a maximum diameter comparable to that of the wafer being polished.

Figure 13:
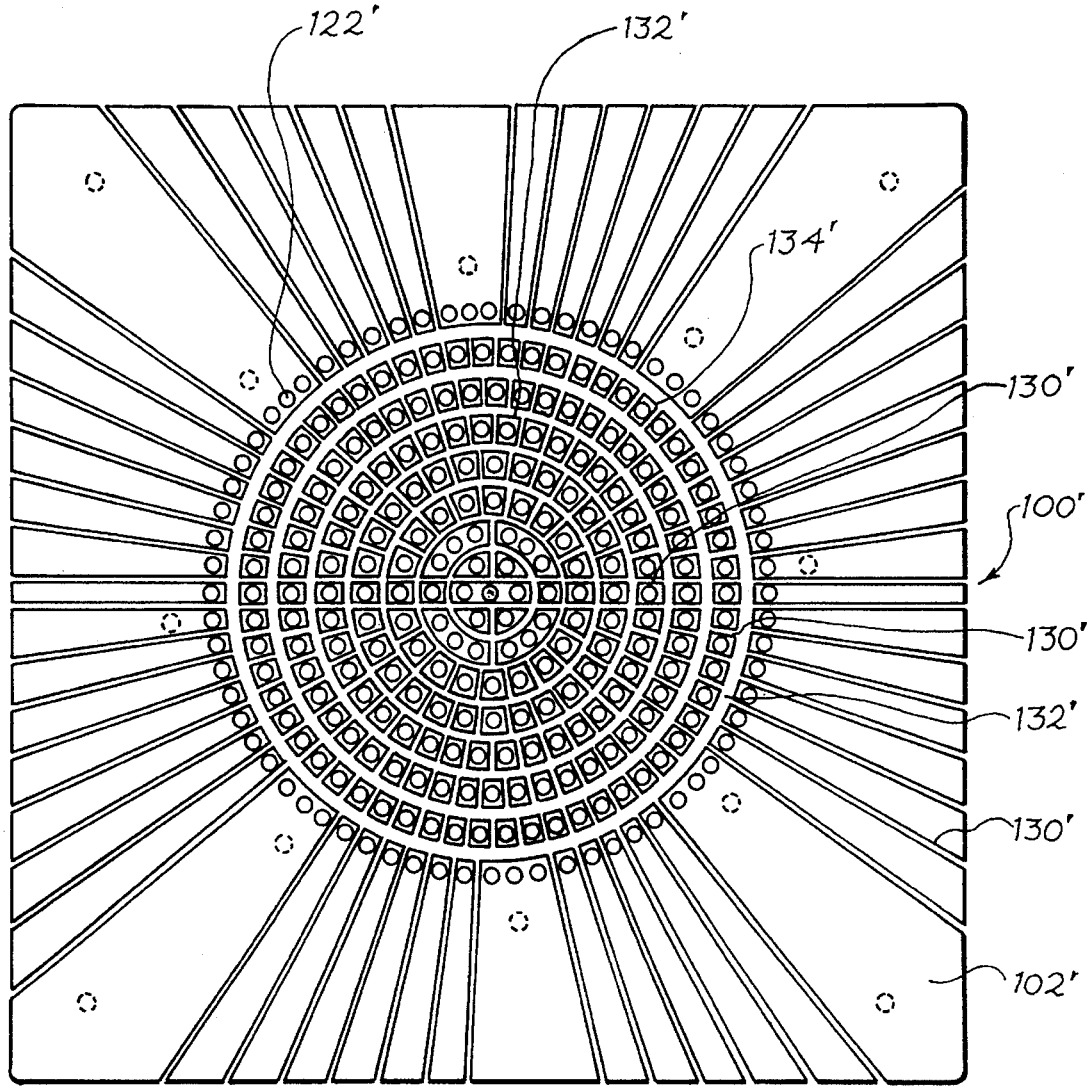
FIG. 13 is a top view of another belt support assembly.

FIG. 13 is a top view of a polishing pad support 100' that is in many ways identical to the support 100 described above. The upper surface of the upper plate 102' includes drainage features including radial grooves 130' and communicating concentric grooves 132'. All of the grooves 130', 132' are in fluid communication with one another, and the spaces between the grooves 130', 132' and the fluid pads 122' constitute raised lands 134'. Fluid passes from the fluid pads 122' to the grooves 130', 132' over the lands 134'. In this way, drainage of the various fluid bearings is enhanced as the movement of fluid toward the periphery of the upper plate 102' is facilitated by the grooves 130', 132'. In all other respects the support 100' is identical to the support 100 described above.

In this embodiment, the grooves 130' 132' are approximately 0.05 inch in depth and are provided with rounded edges to reduce damage to the overlying polishing pad assembly (not shown). The illustrated arrangement provides an asymmetrical arrangement for the grooves 130'. By repositioning the fasteners, it would be possible to achieve a more nearly symmetrical array of grooves 130', which might provide advantages. The grooves 130', 132' could also be adapted for use with the embodiment of FIGS. 4–7.

The fluid bearings described above provide a number of important advantages. The constant flow of fluid out of the bearing allows for no slurry contamination. These fluid bearings provide excellent stiffness and wide-area support, thereby reducing or eliminating cantilever bending of the platen. These bearings are nearly frictionless and vibrationless, and therefore they provide the further advantage of reduced noise. These bearings are extremely stable and robust, and they can readily be adjusted merely by controlling fluid pressure. This lends itself to simple, closed-loop feedback control systems. The preferred bearing fluid is liquid water, which is slurry compatible. These bearings are extremely reliable with hardly any maintenance or wear.

Of course, it should be understood that a wide range of changes and modifications can be made to the preferred embodiments described above. For example, other fluids including gasses can be used in place of water. If desired the fluid bearings can be formed on the platen rather than the support, and the fluid inlet and outlet may be formed on different components. The number of concentric fluid bearings can be modified as desired, and it is not essential in all embodiments that the fluid bearings be arranged in a concentric fashion, or that individual fluid bearings have a circular shape. It is therefore intended that the foregoing detailed description be regarded as illustrative rather than limiting, and that it be understood that it is the following claims, including all equivalents, that are intended to define the scope of this invention.

I claim:

1. In a semiconductor wafer polishing machine of the type comprising at least one polishing pad assembly and at least one wafer holder positioned to hold a semiconductor wafer against the polishing pad assembly, the improvement comprising:

a support positioned adjacent the polishing pad assembly, said support comprising a plurality of fluid bearings that support the polishing pad assembly on the support, each of said fluid bearings comprising:

a respective fluid supply conduit connectable to a separate respective source of fluid at a separate respective pressure;

a respective set of fluid pads, each in fluid communication with the respective fluid supply conduit, said fluid pads configured to direct fluid from the respective fluid supply conduit to support in part the polishing pad assembly on the support.

2. The invention of claim 1 wherein at least some of the sets of fluid pads are arranged in respective concentric rings.

3. The invention of claim 1 wherein the polishing pad assembly comprises at least one polishing pad and a belt supporting the at least one polishing pad for linear translation.

4. The invention of claim 1 wherein at least two of the separate pressures differ from one another in magnitude.

5. The invention of claim 1 wherein the fluid supply conduits each comprise a separate respective mounting feature for connection to the respective source of fluid.

6. The invention of claim 1 wherein each of the fluid supply conduits contains a pressurized fluid at the respective pressure, and wherein at least two of the pressures differ from one another in magnitude.

7. The invention of claim 1 wherein the fluid bearings are separately adjustable with respect to fluid pressure to provide a range of pressure profiles.

8. The invention of claim 1 wherein the bearings comprise a central bearing and peripheral bearing, and wherein the peripheral bearing surrounds the central bearing.

9. In a semiconductor wafer polishing machine of the type comprising at least one polishing pad assembly and at least one wafer holder positioned to hold a semiconductor wafer against the polishing pad assembly, the improvement comprising:

a support positioned adjacent the polishing pad assembly, said support comprising a plurality of fluid bearings that support the polishing pad assembly on the support, each of said fluid bearings comprising:

a respective fluid supply conduit connectable to a respective source of fluid at a respective pressure;

a respective set of fluid pads, each in fluid communication with the respective fluid supply conduit, said fluid pads configured to direct fluid from the respective fluid supply conduit to support in part the polishing pad assembly on the support;

wherein the fluid bearings comprise first and second plates;

said first plate comprising a plurality of concentric grooves, each in communication with a respective one of the fluid supply conduits;

said second plate comprising a plurality of sets of orifices, each set of orifices overlying and aligned with a respective concentric groove;

said first and second plates secured together to hold the orifices in alignment with the respective grooves;

each fluid pad formed in the second plate in communication with a respective orifice.

10. The invention of claim 9 further comprising an array of drainage grooves formed in the second plate between the fluid pads.

11. The invention of claim 10 wherein the drainage grooves comprise both radially extending drainage grooves and concentric drainage grooves.

12. In a semiconductor wafer polishing machine of the type comprising one polishing pad assembly and at least one wafer holder positioned to hold a semiconductor wafer against the polishing pad assembly, the improvement comprising:

a support positioned adjacent the polishing pad assembly, said support comprising a plurality of fluid bearings that support the polishing pad assembly on the support;

said fluid bearings arranged concentrically to provide concentric regions of support for the polishing pad assembly, each fluid bearing coupled to a separate respective source of pressurized fluid at a separate respective pressure.

13. The invention of claim 12 wherein at least two of the separate pressures differ from one another in magnitude.

14. The invention of claim 12 wherein the separate sources are separately adjustable with respect to fluid pressure to provide a range of pressure profiles.

15. The invention of claim 12 wherein the fluid bearings comprise a central bearing and a peripheral bearing, and wherein the respective sources provide pressurized fluid at a higher pressure to the central bearing than to the peripheral bearing.

16. The invention of claim 12 wherein the fluid bearings comprise a central bearing and a peripheral bearing, and wherein the respective sources provide pressurized fluid at a lower pressure to the central bearing than to the peripheral bearing.

17. The invention of claim 12 wherein the bearings comprise a central bearing and a peripheral bearing, and wherein the peripheral bearing surrounds the central bearing.

* * * * *